US005610353A

United States Patent [19]

Hagino

[11] Patent Number: 5,610,353

[45] Date of Patent: Mar. 11, 1997

[54] ELECTRONIC MUSICAL INSTRUMENT CAPABLE OF LEGATO PERFORMANCE

[75] Inventor: Kiyoshi Hagino, Hamamatsu, Japan

[73] Assignee: Yamaha Corporation, Japan

[21] Appl. No.: 147,869

[22] Filed: Nov. 4, 1993

[30] Foreign Application Priority Data

Nov. 5, 1992 [JP] Japan ..... 4-296199

[51] Int. Cl.[6] ..... G10H 7/00; G10H 1/02; G10H 5/00

[52] U.S. Cl. ..... 84/604; 84/627; 84/663

[58] Field of Search ..... 84/602, 604, 626, 84/627, 662, 663, 737, 738

[56] References Cited

U.S. PATENT DOCUMENTS

| | | | |
|---|---|---|---|
| 4,083,283 | 4/1978 | Hiyoshi et al. | 84/1.24 |
| 4,332,183 | 6/1982 | Deutsch | 84/1.26 |
| 4,524,668 | 6/1985 | Tomisawa et al. | 84/1.24 |
| 4,726,276 | 2/1988 | Katoh et al. | 84/1.19 |
| 4,999,773 | 3/1991 | Clynes | 364/419 |
| 5,069,105 | 12/1991 | Iba et al. | 84/605 |
| 5,142,960 | 9/1992 | Iwase et al. | 84/662 |
| 5,216,189 | 6/1993 | Kato et al. . | |
| 5,412,152 | 5/1995 | Kageyama et al. | 84/607 |

*Primary Examiner*—Vit W. Miska
*Attorney, Agent, or Firm*—Graham & James LLP

[57] ABSTRACT

An electronic musical instrument has a waveform memory, a CPU, a tone generator and a keyboard. The waveform memory stores a plurality of waveforms corresponding to musical parameters such as tone colors. The CPU controls the tone generator to generate musical tone signals in response to key-on and key-off events detected from the keyboard. The CPU detects legato performance when a plurality of keys of the keyboard are consecutively depressed and a key-on event is detected prior to a key-off event of the other key which has been previously depressed. When the legato performance is detected, under the control of the CPU, the waveform data except for the attack portion of the waveform are read out from the waveform memory in response to the key-on events which follow the first key-on event, and the musical tone signals are generated by the tone generator based on the read out waveform data.

13 Claims, 6 Drawing Sheets

ELECTRONIC MUSICAL INSTRUMENT CAPABLE OF LEGATO PERFORMANCE

BACKGROUND OF THE INVENTION

1. Field of the Invention

The present invention relates to an electronic musical instrument capable of a legato performance.

2. Background Art

Electronic musical instruments are known which can generate a plurality of types of musical tones. For example, electronic musical instruments employing a waveform memory are known. Various types of musical tone waveforms, for example, musical tone waveforms obtained from various types of non-electronic musical instruments are sampled and converted to digital data, and the digital data thus obtained are stored in the waveform memory of these types of electronic musical instruments. When performing a musical piece, the musical tone waveforms corresponding to the tone color which is designated by the performer are read out from the waveform memory in response to the key depressing operation applied to the instrument.

There are differences between the attack envelope waveforms of the musical tones of the different musical instruments. Furthermore, the waveforms of the attack portions of the musical tones have a plurality of harmonics. The attack envelope waveforms and the spectrums of the attack portions are important elements which present the musical characteristics of the musical tones such as rubbed noises of rubbed string instrument, and noises of guitar sounds, which are generated when the bodies of guitars are vibrated, and blowing noises of musical sounds of wood instruments, and attack vibrato of musical sounds of brass instruments. Therefore, the whole of the musical tone waveforms, which include the attack portions thereof, are stored in the waveform memory of the above-described electronic musical instrument in order to regenerate the musical tones which have the musical characteristics of the corresponding musical instruments.

However, when performing a legato performance by using the electronic musical instrument, such attack portions of musical tone waveforms provide a disadvantage for a smoother legato performance. Because, a plurality of attack portions of the musical tones are consecutively generated.

SUMMARY OF THE INVENTION

In consideration of the above, it is an object of the present invention to provide an electronic musical instrument capable of a smoother legato performance.

The present invention provides an electronic musical instrument for reading out waveform data from a waveform memory and generating musical tones based on the read out of waveform data in response to performance data. The electronic musical instrument has a CPU and a tone generator. The CPU detects legato performance based on the performance data. The CPU designates addresses of waveform data which are to be read out from the memory in response to the performance data in such a manner that an address of an intermediate waveform data of the waveform is designated when the legato performance is first detected. The tone generator reads out waveform data from the waveform memory based on the addresses designated by the CPU.

The present invention further provides an electronic musical instrument for reading out waveform data from a waveform memory and generating musical tones based on the read out waveform data In response to performance data. The electronic musical instrument has a CPU and a tone generator. The CPU detects legato performance based on the performance data. The CPU controls a tone generator in such a manner that an envelope waveform which is different from a waveform for performances except that legato performance is applied to the waveform data when legato performance is detected.

The present invention further provides an electronic musical instrument which has a performance device, a CPU, a control memory, a waveform memory and a tone generator. The performance device generates performance data which order generation of musical tones. The CPU detects legato performance based on the performance data. The memory stores a first address and a second address which correspond to a musical tone. The tone generator reads out waveform data from the waveform memory, under the control of the CPU, in such a manner that:

(a) when the legato performance is not detected by the legato performance detecting means, waveform data corresponding to addresses which follow the first address, are read out; and (b) when the legato performance is detected by the legato performance detecting means, waveform data corresponding to addresses which follow the second address, are read out.

DETAILED DESCRIPTION OF THE PREFERRED EMBODIMENTS

Figure 1:
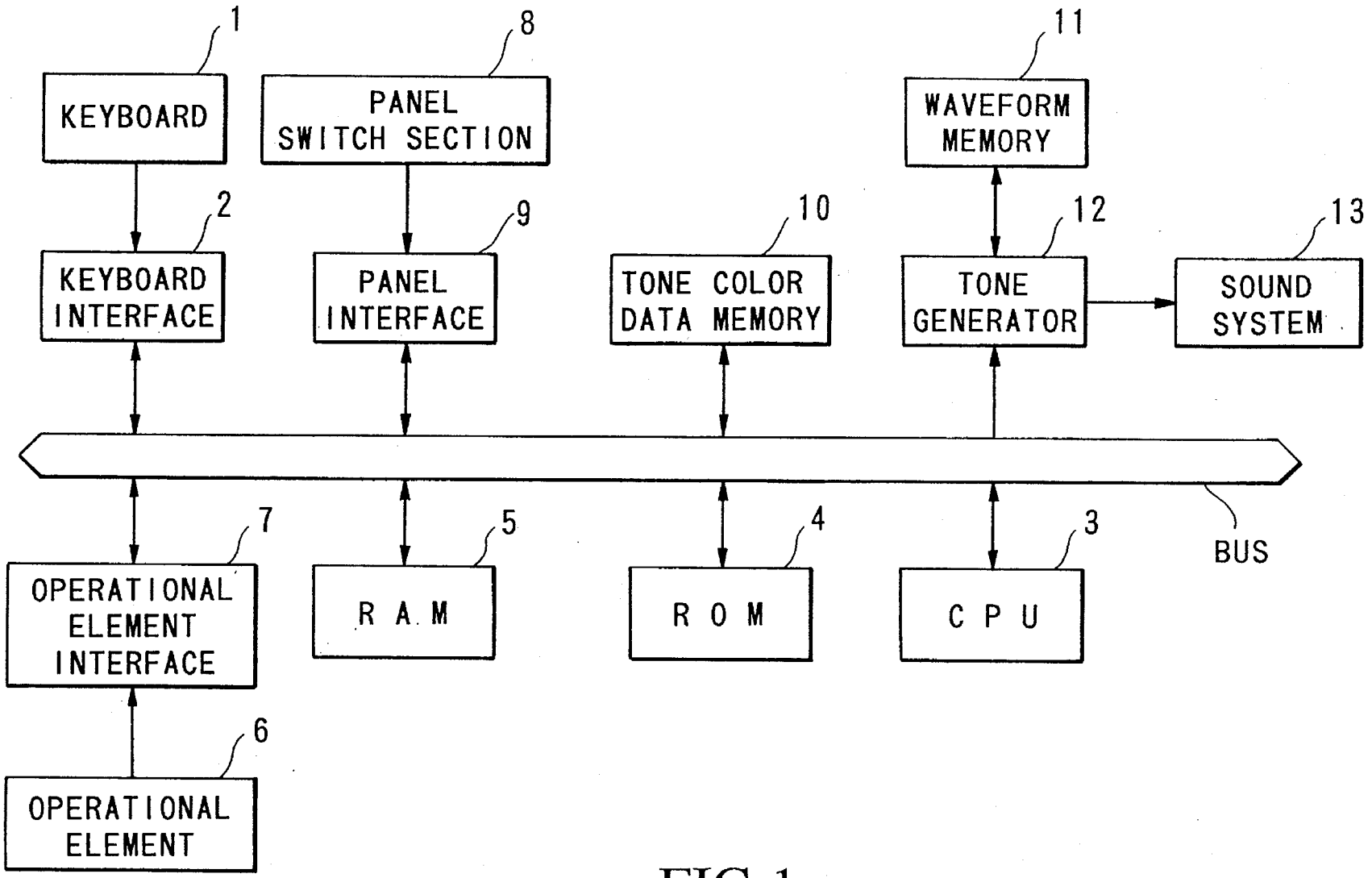
FIG. 1 block diagram showing the configuration of an electronic musical Instrument of the preferred embodiment according to the present invention.

FIG. 1 is a block diagram showing the configuration of an electronic musical instrument of a preferred embodiment according to the present invention. In FIG. 1, 1 designates a keyboard which has a plurality of keys. When any key is depressed by the performer, a signal corresponding to the depressed key is detected from the keyboard 1. Numeral 2 designates a keyboard interface which generates a key-on or key-off signal indicating that a key has been depressed or released, and then a key code corresponding to the key, based on the signal detected from the keyboard, and outputs the signal and code to a data bus.

Numeral 3 designates a CPU (Central Processing Unit). The operation of the CPU will be described later. Numeral 4 designates ROM (Read Only Memory) which stores a plurality of control programs. The control programs stored in the ROM 4 are loaded into the CPU 3. Numeral 5 designates a RAM (Random Access Memory), which is the storage area used by the CPU 3 for temporary storage of computational results, or is used as control registers.

Numeral 6 designates an operational element such as a knee lever. This operational element is used for switching the on/off control of the legato performance. Numeral 7 designates an operational element interface which detects the operation of the operational element 6 and outputs a signal indicating the operation to the data bus. Numeral 8 designates a panel switch section consisting of a plurality of switches such as switches for selecting a tone color, and switches for selecting a single tone generation mode or a multi tone generation mode. Numeral 9 designates a panel switch interface which detects the operation of the switches of panel switch section 8 and outputs a signal based on the detected operation.

Figure 2:
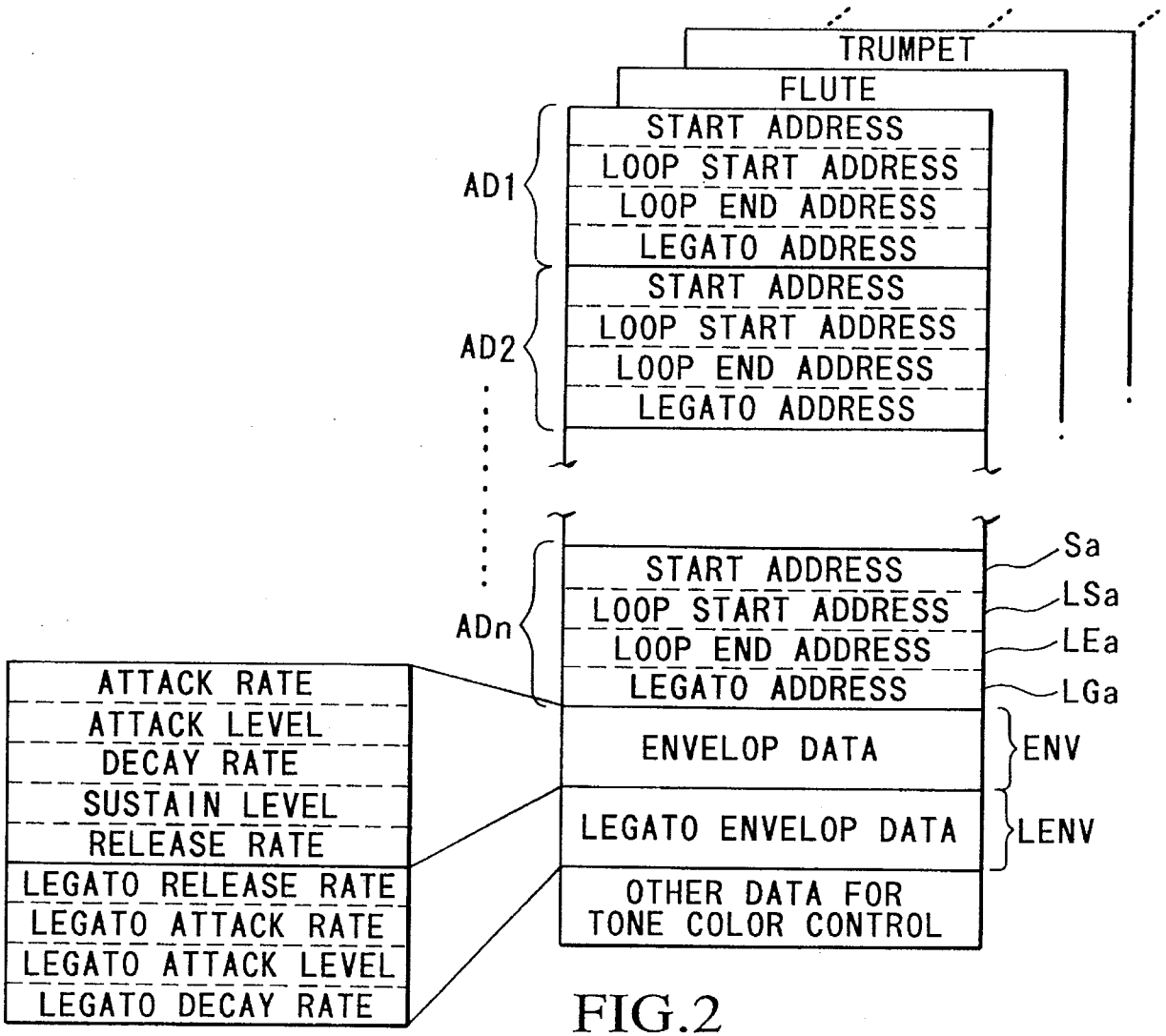
FIG. 2 shows tone color data which is used in the electronic musical instrument shown in FIG. 1.

Numeral 10 designates a tone color data memory. Tone color data corresponding to musical tones of a plurality of non-electronic musical instruments are stored in the tone color data memory 10 as shown in FIG. 2. Each tone color data contains n address data AD1 to ADn which are to be applied to a waveform memory 11 (this memory will be described later) as the read out addresses. The address data AD1 to ADn, respectively, correspond to tone pitch groups and the tone pitch groups correspond to the groups of keys which are obtained by dividing the keys of the keyboard 1 by n. When a key corresponding to a tone pitch group k is depressed, the address data ADk which corresponds to the group k is read out from the tone color data memory 10 and is used for designating the address of waveform data which is to be read out from the waveform memory 11. Each address data ADk (k=1 to n) consists of a start address Sa, a loop start address LSa, a loop end address LEa and a legato address LGa. The read out operation using these addresses will be described later.

Figure 3A:
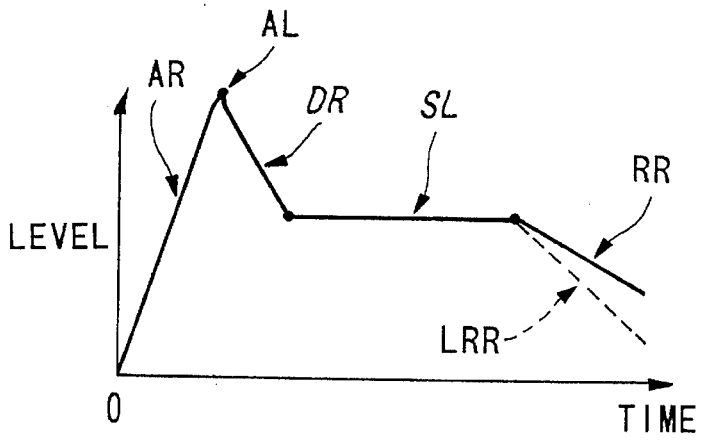
FIGS. 3(A) and 3(B) show envelope waveforms generated by the electronic musical instrument shown in FIG. 1.
Figure 3B:
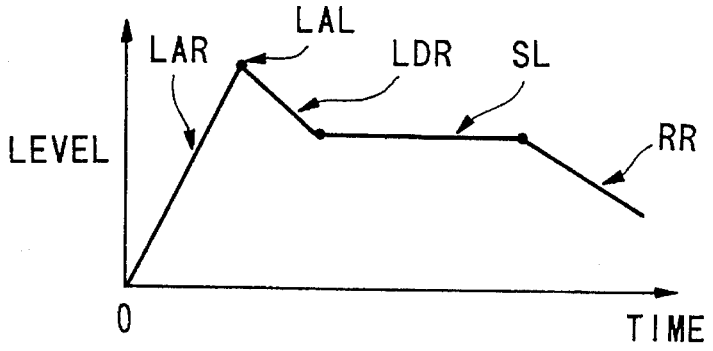

Each tone color data further contains an envelope data corresponding to the tone color, a legato envelope data used only for the legato performance, and other tone color control data. The envelope data ENV consists of an attack rate AR, a decay rate DR, a sustained level SL and a release rate RR which are used for controlling the envelope waveform of a musical tone to be generated, for example, as shown in FIG. 3(A). The legato envelope data LENV consists of a legato release rate LRR, a legato attack rate LAR, a legato attack level LAL and a legato decay rate LDR which are used for controlling the envelope waveform of a musical tone when the legato performance is performed. More specifically, when the first and second keys are consecutively depressed to perform the legato performance, the attack portion of the envelope waveform corresponding to the second key-on is formed based on the legato attack rate LAR, the legato attack level LAL and the legato decay rate LDR, as shown in FIG. 3(B). The other portion is formed based on the sustain level SL and the release rate RR. Therefore, the same envelope waveforms are obtained in accordance with the portions, except for the attack portion, regardless of whether the legato performance is performed. The legato release rate LRR is used for controlling the waveform of the release portion of the envelope waveform corresponding to the first key-on.

Figure 4:
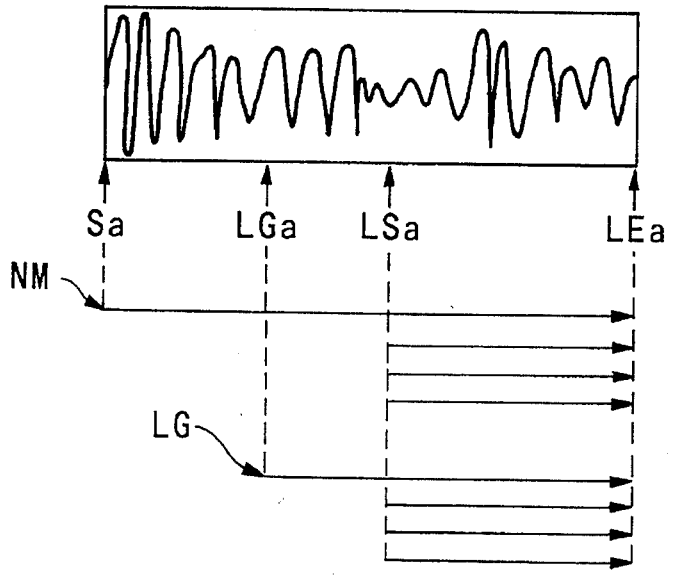
FIG. 4 shows a musical tone waveform generated by the electronic musical instrument shown in FIG. 1.

The waveform memory 11 stores a plurality of musical tone waveforms which correspond to the combinations of the tone colors and the tone pitch groups. The address data stored in the above-described tone color data memory are supplied to the waveform memory 11 in a manner as shown in FIG. 4. When the legato performance is not performed and a normal performance is performed, the waveform data corresponding to the addresses from the start address Sa to the loop end address LEa are read out from the waveform memory 11, after which the waveform data corresponding to the addresses from the loop start address LSa to the loop end address LEa are repeatedly read out, as indicated by arrows NM.

In contrast, when the legato performance is performed, the waveform data corresponding to the addresses from the legato address LGa to the loop end address LEa are read out from the waveform memory 11, after which the waveform data corresponding to the addresses from the loop start address LSa to the loop end address LEa are repeatedly read out. That is to say, the waveform data corresponding to the attack portion addressed from the start address Sa to the legato address LGa are not read out when the musical tone waveform corresponding to the second key-on is generated.

In FIG. 1, 12 designates a tone generator which reads out the waveform data from the waveform memory 11 based on the address data and the other control signals supplied from the CPU 3, and generates a musical tone signal based on the waveform data. The tone generator 12 has a plurality of tone generation channels for generating musical tone signals. When the single tone generation mode is designated as the operation mode, only one tone generation channel is available for generating a musical tone signal in response to a key-on event. When the multi tone generation mode is designated as the operation mode, then all the tone generation channel is are available for generating musical tone signals in response to a key-on event.

Figure 5:
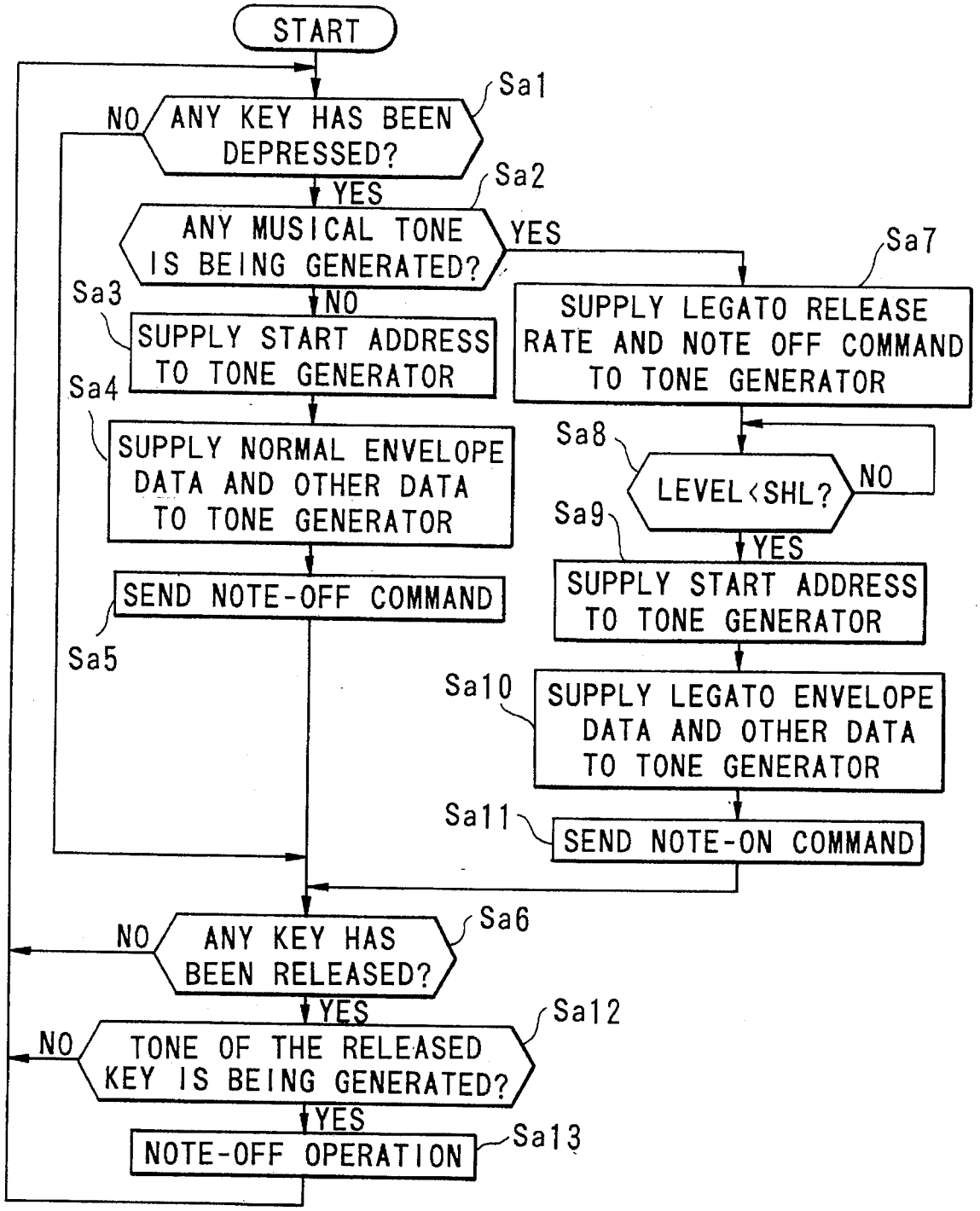
FIGS. 5 and 6 are flow charts showing the operation of the electronic musical instrument shown in FIG. 1.
Figure 6:
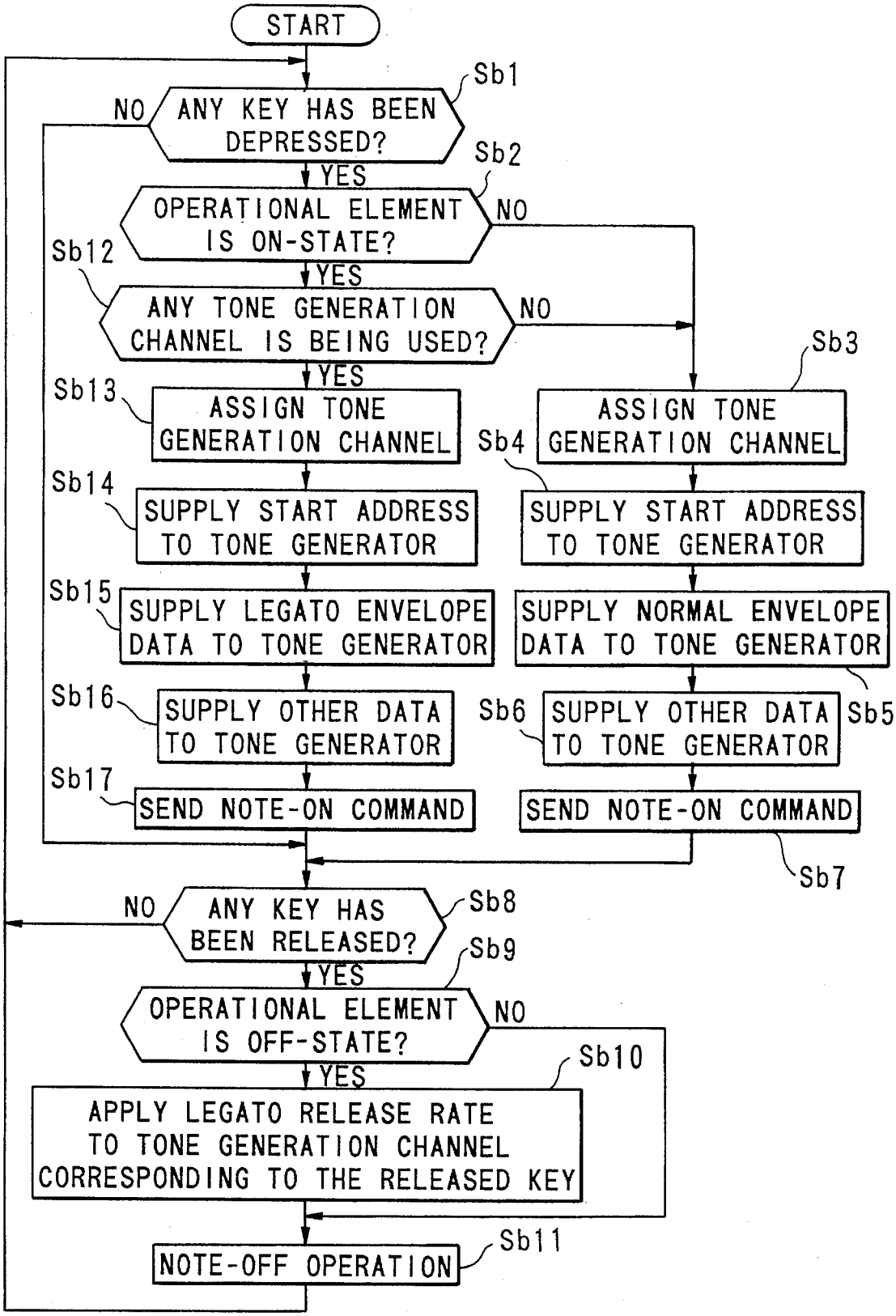

Next, the operation of the electronic musical instrument is described in accordance with the single tone generation mode and the multi tone generation mode with reference to the flow chart shown in FIGS. 5 and 6.

A. Operation of single tone generation mode

When the power switch of the electronic musical instrument is switched to the on-state and electric power is supplied to the portions of the instrument, the CPU 3 loads the control program from the ROM 4. When the single tone generation mode is designated by the switch of the panel switch section 4, the CPU 3 executes the single tone generating routine, the flow of which is shown in FIG. 5.

(1) Operation corresponding to first key-on of legato performance

In step Sa1, the CPU 3 Judges whether a key-on event is detected from the key-board or not, based on the signal from the keyboard interface 2. When the first key-on of the legato performance is detected by the CPU 3, the result of this judgement is [YES] and the routine thereby proceeds to step Sa2.

In step Sa2, a judgement is made as to whether any musical tone signal is being generated by the tone generator 12. When the first key-on of the legato performance is detected and no musical tone signal is generated by the tone generator 12, the result of this judgement is [YES] and the routine thereby proceeds to step Sa3. In step Sa3, the address data corresponding to the combination of the tone color designated by the switch of the panel switch section 4 and the tone pitch group corresponding to the depressed key, are read out from the tone color data memory 10 (FIG. 2), and the address data are supplied to the tone generator 12. More specifically, the start address Sa, the loop start address LSa and the loop end address corresponding to the above combination are read out and are supplied to the tone generator 12.

Next, in step Sa4, the envelope data ENV corresponding to the tone color designated by the switch of the panel switch section, more specifically, the attack rate AR, the attack level AL, the decay rate DR, the sustain level SL and the release rate RR corresponding to the tone color, are read out from the tone color data memory 10 and are supplied to the tone generator 12.

Next, in step Sa5, the CPU 3 supplies the key code corresponding to the depressed key to the tone generator 12 and orders the tone generation for the key code. The tone generator 12 then reads out the waveform data from the waveform memory 11 based on the address data supplied from the CPU 3 in step Sa3 as indicated by the arrow NM in FIG. 4. The tone generator 12 applies the envelope which has been received from the CPU 2 in step Sa4 to the waveform data thus read out, as shown in FIG. 3(A). In this manner, the musical tone signal is generated by the tone generator and is outputted via the sound system 13 as a musical sound.

Next, in step Sa6, a judgement is made by the CPU 3 as to whether any key-off event Is detected from the key-board, based on the signal from the keyboard interface 2. When no key-off event is detected from the keyboard 1, the routine returns to the above-described step Sa1. In step Sa1, a judgement is made as to whether the second key-on event which follows the above-described first key-on event is detect. When the result of this judgement is [NO], the routine proceeds to step Sa6. In this manner, when the legato performance is performed, the steps Sa1 and Sa6 are repeated during the interval between the first key-on to the second key-on.

(2) Operation after the second key-on of legato performance

When the second key of the legato performance is depressed and the key-on event is detected by the CPU 3, the result of the judgement in step Sa1 becomes [YES] and the routine thereby proceeds to step Sa2. In step Sa2, a judgement is made as to whether any musical tone signal is being generated by the tone generator 12. When the key-on event of the second key-on is detected prior to the key-off of the first key, the result of the judgement in step Sa2 is [YES] and the routine thereby proceeds to step Sa7. In step Sa7, the legato envelope data corresponding to the present tone color designated by the switch of the panel switch section 8 are read out from the tone color data memory 10, and the legato release rate LRR included in the legato envelope data and a note off command are supplied to the tone generator 12 by the CPU 3. As a result, the envelope level of the musical tone corresponding to the first key is gradually attenuated based on the legato release rate LRR. The legato release rate LRR may be defined as different values which are suitable for respective tone colors. It 1s preferable to define the legato release rate LRR so as to be larger than the release rate RR.

Next, in step Sa8, a judgement is made as to whether the envelope level of the musical tone signal is equal to or less than a predetermined threshold level SHL. When the envelope level of the musical tone signal is greater than the threshold level SHL, the result of this judgement is [NO]. The judgement of step Sa8 is repeated until the envelope level becomes equal to or less than the threshold level.

When the envelope level of the musical tone signal is attenuated and becomes equal to or less than the threshold level SHL, the result of the judgement in step Sa8 becomes [YES] and the routine thereby proceeds to step Sa9. In step Sa9, the address data corresponding to the combination of the tone color currently selected and the tone pitch group which corresponds to the depressed key are read out from the tone color data memory 10 (FIG. 2), and are supplied to the tone generator 12. In this case, the address data supplied to the tone generator 12 are the legato address LGa, the loop start address LSa and the loop end address LEa for reading out the waveform data of the musical tone corresponding to the second key-on event of the legato performance.

Next, In step Sa10, the legato envelope data LENV and the other tone color control data corresponding to the tone color currently selected, are read out from the tone color data memory 10 and are supplied to the tone generator 12. More specifically, the legato envelope data LENV supplied to the tone generator 12 are the legato attack rate LAR, the legato attack level LAL and the legato decay rate LDR.

Next, in step Sa11, the CPU 3 supplies to the tone generator 12 the key code corresponding to the depressed key and orders the tone generation for the depressed key. The tone generator 12 reads out the waveform data from the waveform memory 11 based on the address data which has been received from the CPU 3 in step Sa9 (i.e., the reading operation indicated by LG in FIG. 4). Thereafter, the tone generator 12 applies the legato envelope data which have been received from the CPU 3, In step Sa4, to the waveform data thus read out (FIG. 3(B)). In this case, the envelope data which are not the legato envelope data, are used for generating the sustained portion and the portions following the sustained portion. In this manner, the musical tone signal is formed, and the musical tone signal, which is thus formed, is outputted as a musical sound corresponding to the second key-on event via the sound system 13.

Next, in step Sa6, a judgement is made as to whether the key-off event is detected from the keyboard 1. When the performer releases the key corresponding to the first key-on event of the legato performance during the tone generation for the second key-on event of the legato performance, the result of the judgement in step Sa6 is [YES] and the routine thereby proceeds to step Sa12. In step Sa12, a judgement is made as to whether the musical tone signal corresponding to the released key (in this case, the released key is the first key of the legato performance) is being generated by the tone generator 12 or not. The result of this judgement is [YES] and the routine thereby returns to step Sa1 because the musical tone signal corresponding to the first key of the legato performance has already been attenuated in step Sa7. When the next key-on event is detected from the keyboard 1 during the tone generation of the second key of the legato performance, the operations of steps Sa7 to Sa11 are executed again to control the tone generator 12 in order to generate the musical tone signals for the legato performance. In this manner, the operations of steps Sa1, Sa2, Sa7 to Sa11, Sa6 and Sa12 are repeated to maintain the legato performance if the new key-on event is detected during the tone generation for the previously detected key-on event.

(3) Operation for normal performance

When the legato performance has ended and the normal performance is performed, the CPU 3 may detect that no musical tone signal is generated by the tone generator 12. When the CPU 3 detects that no signal is generated by the tone generator 12, the result of the judgement in step Sa2 is [NO] and the above-described operations of steps Sa3 to Sa5 are executed to perform the normal performance. When the key, which has been depressed, is released prior to the next key-on event, the result of the judgement in steps Sa6 and Sa12 are [YES] and the routine thereby proceeds to step Sa13.

In step Sa13, the note-off command is given to the tone generator 12 to attenuate the envelope level of the present musical tone signal based on the release rate RR. Next, the routine returns to step Sa1, and the judgements of steps Sa1 and Sa6 are repeated until the next key-on event is detected. In this manner, when no musical tone signal is generated, the operations of steps Sa3 to Sa5 are executed in response to the detection of the new key-on event so that the musical tone signal corresponding to the detected key-on event is generated, and the operation of step Sa13 is executed in response to the detection of the key-off event.

Figure 7:
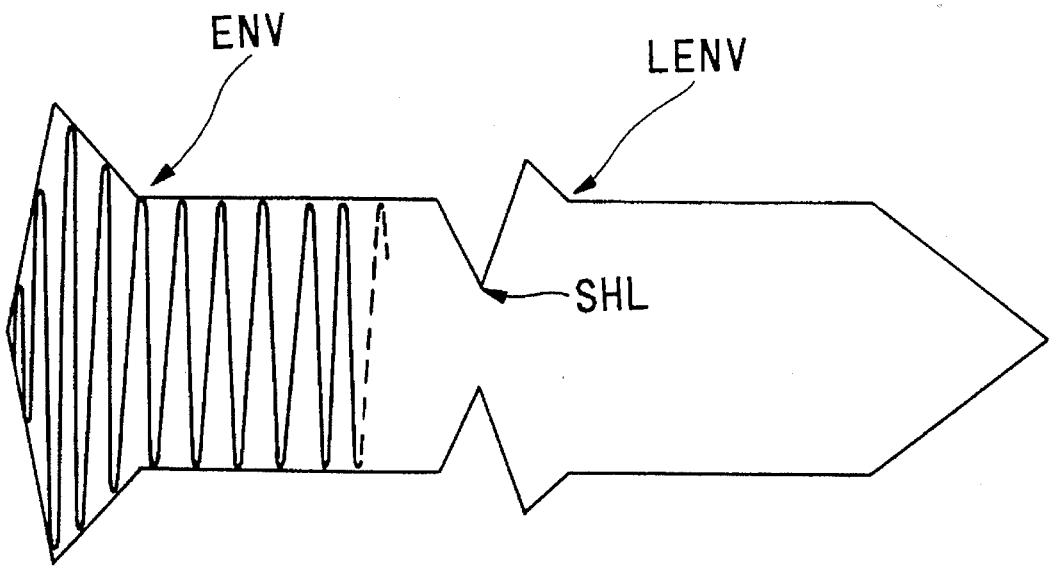
FIGS. 7 and 8 show envelope waveforms generated by the electronic musical instrument shown in FIG. 1.
Figure 8:
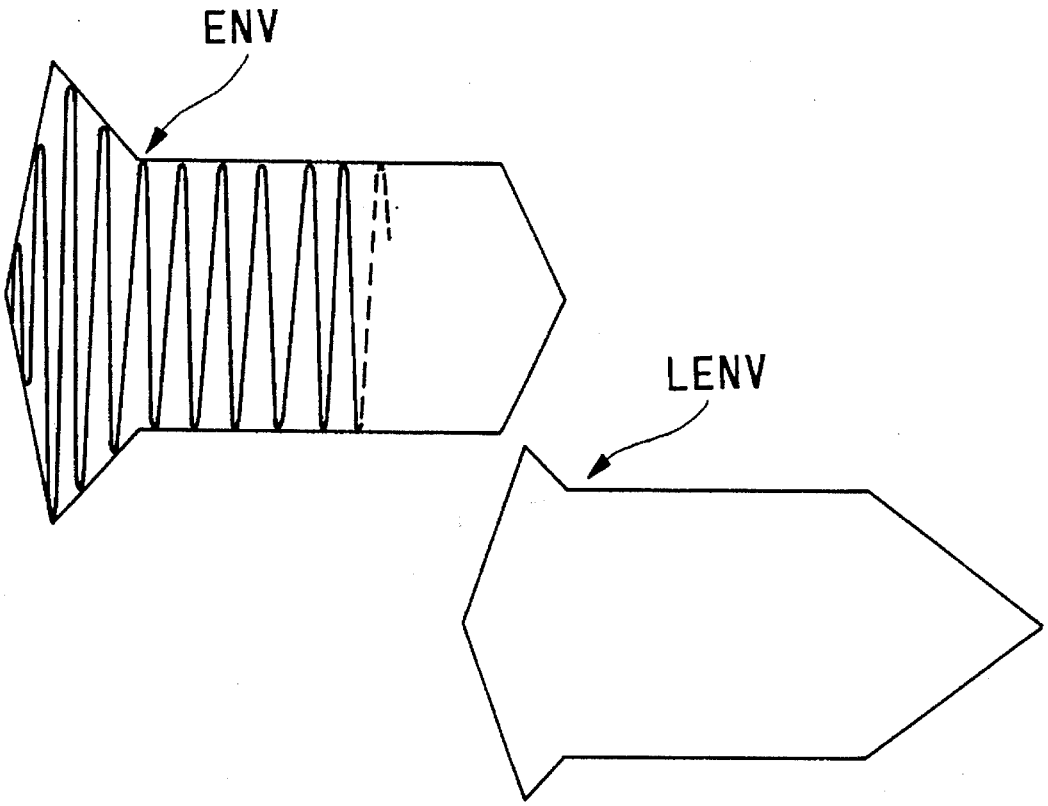

As described above, when the first key-on event of the legato performance is detected in the single tone generation mode, the musical tone signal corresponding to the key-on event is generated based on the envelope data ENV which is the data used for the tone generation for the normal performance. When the second key-on event of the legato performance is detected, i.e., when the second key-on event is detected prior to the key-off event of the first key, the envelope level of the musical tone signal generated by the tone generator 12 is controlled based on the legato envelope data LENV so that the musical tone signal having a weak attack is obtained as shown in FIG. 7. The tone generation for the second key-on event begins when the the envelope level of the musical tone signal corresponding to the previously depressed key is attenuated and becomes equal to or less than the threshold level SHL.

B. Operation of multi tone generation mode

When the multi tone generation mode is designated by the switch of the panel switch section 4, the CPU 3 executes the routine for the multi tone generation mode; the flow chart thereof is shown in FIG. 6.

(1) Operation which is executed when operational element 6 is off-state

In step Sb1, the CPU 3 judges whether any key of the keyboard 1 has been depressed, based on the signal obtained from the keyboard interface 2. When a key of the keyboard 1 is depressed and the key-on event is detected by the CPU 3, the result of the judgement in step Sb1 is [YES] and the routine thereby proceeds to step Sb2. In step Sb2, the CPU 3 judges whether the operational element 6 is on-state or not, based on a signal obtained from the operational element interface 7.

When the operational element 6 is on-state, the result of the judgement in step Sb2 is [NO] and the routine thereby proceeds to step Sb3. In step Sb3, one of the tone generation channels is selected and the tone generation for the key-on event is assigned to the selected channel. Next, in step Sb4, the CPU 3 reads out from the tone color data memory 10, the address data corresponding to the combination of the tone color designated by the switch of the panel switch section 4 and the tone color group which corresponds to the depressed key. The CPU 3 then supplies the start address Sa, the loop start address LSa and the loop end address LEa, which are included in the address data, to the tone generator 12.

Next, in step SbS, the CPU 10 reads the envelope data ENV, which is the data used for the normal performance and correspond to the designated tone color, and supplies the attack rate AR, the attack level AL, the decay rate DR, the sustained level SL and the release rate RR, which are included in the envelope data ENV, to the tone generator 12. Next, in step Sb6, the other data for tone color control are read out from the tone color data memory 10, and are supplied to the tone generator 12.

Next, in step Sb7, the CPU 3 supplies the key code corresponding to the depressed key to the tone generator 12 and orders the tone generation. As a result, the CPU 3 reads out the waveform data from the waveform memory 11 based on the address data, which has been received in step Sb4 (arrow NM in FIG. 4). The CPU 3 applies the envelope, which has been received in step Sa5, to the waveform data thus read out (FIG. 3(A)). As a result, the musical tone signal is obtained and is outputted as the musical sound via the sound system 13.

Next, in step Sb8, the CPU 3 judges whether any key-off event is detected from the keyboard 1 or not, based on the signal obtained from the keyboard interface 2. When no keyoff event is detected from the keyboard 1, the routine returns to step Sb1. Thereafter, the judgements of step Sb1 and Sb8 are repeated until the next key-on or key-off event is detected.

When the depressed key is released, the result of the judgement in step Sb8 is [YES] and the routine thereby proceeds to step Sb9. In step Sb9, a judgement is made as to whether the operational element 6 is on-state. When the operational element 6 is on-state, the result of this judgement is [YES] and the routine thereby proceeds to step Sb11. In step Sb11, the CPU 3 outputs the note off command to the tone generator 12 to stop the tone generation corresponding to the released key. As a result, the musical tone signal which is generated by one of the tone generation channel is of the tone generator 12 and corresponds to the released key is attenuated over time at a rate designated by the release rate RR which has been received in step Sb5. When the next key-on event is detected by the CPU 3, the result of the judgement in step Sb1 is [YES] and the operations of steps Sb2 to Sb7 are executed again so that the musical tone signal is generated based on the detected key-on event.

In contrast, when the new key-on event is detected prior to the detection of the key-off event of the key which has been previously depressed, the result of the judgement in step Sb1 is [YES] and the routine thereby proceeds to step Sb2. When the operational element 6 is off-state, the result of the judgement in step Sb2 is [NO] and the operations of the above described steps Sb3 to Sb7 are executed to generate the musical tone signal corresponding to the new key-on event. In this manner, the musical tone obtained by the legato performance is not obtained and the normal musical tone is generated through the operations of steps Sb3 to Sb7 even if the legato performance (i.e., the performance in which the second key is depressed during the tone generation corresponding to the first depressed key) is performed.

(2) Operation carried out when operational element 6 is on-state

When the key-on event is detected at the timing of step Sb1, the result of the judgement in step Sb1 is [YES] and the routine thereby proceeds to step Sb2. In step Sb12, a judgement is made as to whether the operational element 6 is on-state. When the operational element 6 is on-state, the result of this judgement is [YES] and the routine thereby proceeds to step Sb12. In step Sb12, a judgement is made as to whether at least one of the tone generation channels is being used for the tone generation.

When there is no tone generation channel which is being used for the tone generation, the result of the judgement in step Sb12 is [NO] and the normal tone generation is executed through the operations of steps Sb3 to Sb7. Thereafter, the judgements of steps Sb8 and Sb1 are repeated until the next key-on or key-off event is detected.

When the performer performs the legato performance, the key-on event of the second key is detected prior to the detection of the key-off event of the first key. As a result, the result of the judgement in step Sb8 becomes [NO] and the result of the judgement in step Sb1 becomes [YES]. Therefore, the routine proceeds to step Sb2. In step Sb2, a judgement is made as to whether the operational element 6 is on-state.

When the operational element 6 is on-state, the result of this judgement is [YES] and the routine thereby proceeds to step Sb12. In step Sb12, a judgement is made as to whether at least one of the tone generation channels is being used for the tone generation. In this case, the result of this judgement is [YES] and the routine thereby proceeds to step Sb13 because one of the tone generation channels is being used for generating the musical tone corresponding to the first key-on event of the legato performance.

In step Sb13, one of the tone generation channels is selected and the tone generation corresponding to the second key-on event is assigned to the selected channel. Next, in step Sb14, the address data corresponding to the combination of the tone color designated by the switch of the panel switch section 4 and the tone color group which corresponds to the depressed key are read out from the tone color data memory 10. The legato address LGa, the loop start address LSa and the loop end address LEa, which are included in the address data read out as described above, are supplied to the tone generator 12.

Next, in step Sb15, the legato envelope data LENV corresponding to the tone color designated as above is read out from the tone color data memory 10. The legato attack rate LAR, the legato attack level LAL and the legato decay rate LDR, which are included in the legato envelope data read out as described above, are supplied to the tone generator 12. Furthermore, the sustained level SL and the release rate RR, which are included in the envelope data used for the normal performance, are supplied to the tone generator 12. Next, in step Sb16, the other data for the tone color control are read out from the tone color data memory 10 and are supplied to the tone generator 12.

Next, in step Sb17, the CPU 3 supplies the key code corresponding to the depressed key and the note on command to the tone generator 12. As a result, the tone generator 12 reads out the waveform data from the waveform memory 11 based on the address data which has been received in step Sb14 (arrow LG in FIG. 4) and applies the legato envelope, which has been received in step Sa15 to the read out waveform data, as shown in FIG. 3(B). In this manner, the musical tone which has an weak attack component is outputted.

When the depressed key is released and the key-off event is detected by the CPU 3, the result of the judgement in step Sb8 is [YES] and the routine thereby proceeds to step Sb9. When the operational element 6 is on-state, the result of the judgement in step Sb9 is [YES] and the routine proceeds to step Sb10. In step Sb10, the legato release rate, which is included in the legato envelope data read out as above, is supplied to the tone generator 12. Next, in step Sb11, the note off command is given for the tone generation channel which is being used for generating the musical tone signal corresponding to the first key-on event of the legato performance. As a result, the musical tone corresponding to the first key-on event is attenuated to zero level at the release rate LRR which is suitable for the legato performance.

In this manner, when the second key is depressed prior to the key-off of the first key, the tone generation for the legato performance is executed through the operations of steps Sb13 to Sb17. When the key-off event is detected during the legato performance, the key-off operation for the legato performance is executed through the operations of steps Sb10 and Sb11.

If the performer ends the legato performance and begins another performance, key-on events are detected when no tone generation channel is used for the tone generation. Therefore, the result of the judgement in step Sb12 is [YES] and the steps Sb3 to Sb7 are executed to generate the musical tone so that a performance which is not a legato performance is performed.

As described above, in the multi tones generating mode in which a plurality of tone generation channels may be simultaneously used for tone generation, even if a plurality of keys simultaneously become on-state, the tone generation for legato performance is executed only when the operational element 6 is on-state. More specifically, when the performer sets the operational element 6 into on-state and performs a legato performance, the normal envelope ENV is applied to the waveform data to generate the musical tone signal only when the first key-on event of the legato performance is detected. Thereafter, the legato envelope data LENV is applied to the waveform data to generate the musical tone signals in response to the key-on events, following the first key-on event. As a result, consecutive musical tones which have weak attack components are obtained. In contrast, when the performer sets the operational element 6 into off-state consecutively depresses keys of the keyboard 1 in such a manner that a plurality of keys simultaneously become on-state, a legato performance is not performed and a plurality of musical tone signals are independently generated based on the corresponding key-on and key-off events.

The above described embodiment provides an advantage in that smoother legato performance can be performed because musical tones having a weak attack component are generated in response to the key-on events following to the first key-on event of the legato performance.

<Modification>

The range of the present invention is not limited within the above-described preferred embodiment. Many modifications may be applied to the embodiment, for example as follows:

(1) The above-described embodiment shows the example of the keyboard electronic musical instrument according to the present invention. However, the present invention can be applicable for the other types of the electronic musical instrument such as wind electronic musical instruments and string electronic musical instrument. For example, when implementing a wind electronic musical instrument according to the present invention, legato performance may be detected by detecting that different tone pitches are consecutively designated with no tonguing operation. Furthermore, for example, when implementing a plucked string type electronic musical instrument such as guitars according to the present invention, legato performance may be detected by detecting that different tone pitches are consecutively designated with no picking operation.

(2) Portamento performance function, which controls the tone pitch of the musical tone in such a manner that the tone pitch is gradually varied over time in response to the changing of the tone pitch to be generated, or glissando performance function, which controls the tone pitch of the musical tone in such a manner that the tone pitch is sequentially varied at a predetermined step value, may be employed in an electronic musical instrument together with the legato performance function described in the above embodiment. In this case, the portamento performance function, the glissando performance function or the legato performance function may be selected based on the tone color.

(3) In the above-described preferred embodiment, the threshold level SHL, which is used in the single tone generating mode, may be changed based on the designated musical parameter such as tone colors.

(4) The operational element 6 for designating whether a legato performance control should be enabled or not is not limited to a knee lever. The operational element 6 may be the other element, for example, a pedal.

(5) In the above-described preferred embodiment, key-on and key-off event, which are performance data detected from the keyboard, are directly used for controlling the legato performance control. However, performance data for controlling legato performance are not limited to such key operation events. For example, automatic performance data, which are stored in a memory and used for controlling automatic performance apparatus, may be used as performance data in the above-described electronic musical instrument.

What is claimed is:

1. An electronic musical instrument for reading out waveform data from a waveform memory and generating musical tones based on the read out waveform data in response to performance data, said electronic musical instrument comprising:

legato performance detecting means for detecting legato performance based on the performance data;

memory means for storing addresses of waveform data;

address designating means for designating addresses of waveform data which are to be read out from the memory in response to the performance data, said addresses including a normal start address, a legato start address, a loop start address and a loop end address, said addresses being designated in such a manner that an address corresponding to said legato start address is designated when the legato performance is detected by the legato performance detecting means; and read out means for reading out waveform data from the memory based on the addresses designated by the address designating means.

2. An electronic musical instrument according to claim 1 wherein said legato performance means detects the legato performance when a plurality of performance data are consecutively generated and a plurality of musical tones are simultaneously generated in response to the performance data.

3. An electronic musical instrument according to claim 1 further comprising a control switch having an on-state and an off-state, wherein said read out means simultaneously reads out waveform data which correspond to a plurality of musical tones, and said address designating means designates addresses based on a state of the control switch in such a manner that: (a) when the control switch is in the on-state and the legato performance is detected by the legato performance detecting means, an address of an intermediate waveform data of the waveform is designated; and (b) when the control switch is in the off-state, an address of a leading waveform data of the waveform is designated even if the legato performance is detected by the legato performance detecting means.

4. An electronic musical instrument according to claim 1, further comprising a keyboard for generating key-on and key-off events as aid performance data in response to key operations applied thereto.

5. An electronic musical instrument for reading out waveform data from a memory and generating musical tones based on the read out waveform data in response to performance data, said electronic musical instrument comprising:

legato performance detecting means for detecting legato performance based on the performance data;

envelope applying means for applying an envelope waveform to the waveform data in such a manner that the envelope waveform which is applied to the waveform data when legato performance is detected by the legato performance detecting means is different from the envelope waveform applied when a legato performance is not detected by the legato performance detecting means;

memory means for storing a normal start address and a legato start address which correspond to a musical tone; and read out means for reading out waveform data from the memory in such a manner that:

(a) when legato performance is not detected by the legato performance detecting means, waveform data corresponding to addresses which follow the normal start address, are read out; and (b) when legato performance is detected by the legato performance detecting means, waveform data corresponding to addresses which follow the legato start address, are read out.

6. An electronic musical instrument according to claim 5 wherein said legato performance means detects the legato performance when a plurality of performance data are consecutively generated and a plurality of musical tones are simultaneously generated in response to the performance data.

7. An electronic musical instrument according to claim 5 further comprising a control switch having an on-state and an off-state, wherein said envelope applying means simultaneously applies a plurality of envelope waveforms to the waveform data corresponding to a plurality of musical tones based on a state of the control switch in such a manner that: (a) when the control switch is in the on-state and legato performance is detected by the legato performance detecting means, the envelope waveform data applied by the envelope applying means to the waveform data is different from the envelope waveform applied when a legato performance is not detected by the legato performance detecting means; and (b) when the control switch is in the off-state and legato performance is detected by the legato performance detecting means, the envelope waveform data applied by the envelope applying means is the same as the envelope applied when a legato performance is not detected.

8. An electronic musical instrument according to claim 5, further comprising a keyboard for generating key-on and key-off events in response to key operations applied thereto.

9. An electronic musical instrument according to claim 5 wherein the musical tones generated by the electronic musical instrument when the legato performance detecting means detects a legato performance include waveforms having applied thereto the envelope data corresponding to a legato performance.

10. An electronic musical instrument comprising:

performance means for generating performance data which order generation of musical tones;

legato performance detecting means for detecting legato performance based on the performance data;

memory means for storing a normal start address and a legato start address which correspond to a musical tone; and read out means for reading out waveform data from the memory in such a manner that:

(a) when legato performance is not detected by the legato performance detecting means, waveform data corresponding to said normal start address are read out; and (b) when legato performance is detected by the legato performance detecting means, waveform data corresponding to said legato start address are read out.

11. An electronic musical instrument according to claim 10 further comprising an envelope applying means for applying an envelope waveform to the waveform data in such a manner that the envelope waveform applied when legato performance is detected by the legato performance detecting means is different from the envelope waveform applied when a legato performance is not detected by the legato performance detecting means.

12. An electronic musical instrument according to claim 10 wherein the second address follows the first address in the memory means.

13. An electronic musical instrument according to claim 10 wherein the memory means stores a loop start address and the second address is between the first address and the loop start address.

* * * * *